United States Patent [19]

Jespersen

[11] 3,965,349

[45] June 22, 1976

[54] TIME SWITCH WITH ADJUSTABLE PROGRAM

[75] Inventor: Aksel Jespersen, Sonderborg, Denmark

[73] Assignee: Danfoss A/S, Nordborg, Denmark

[22] Filed: Feb. 18, 1975

[21] Appl. No.: 550,722

[30] Foreign Application Priority Data

Feb. 21, 1974 Germany ..... 2408343

[52] U.S. Cl. ..... 250/236; 250/231 SE; 250/233; 250/237 R; 340/309.1

[51] Int. Cl.[2] ..... H01J 39/12; G08B 1/00

[58] Field of Search ..... 250/237 R, 231 R, 231 SE, 250/229, 230, 233, 236, 200, 216, 566; 315/360; 200/37 R; 340/309.1, 309.4, 309.5, 309.6

[56] References Cited

UNITED STATES PATENTS

| | | | |
|---|---|---|---|
| 1,618,242 | 2/1927 | Thompson | 250/566 X |
| 2,080,330 | 5/1937 | Ottaway | 340/309.5 |
| 3,290,507 | 12/1966 | Flieg et al. | 250/233 X |
| 3,399,347 | 8/1968 | Martens | 250/231 SE X |

*Primary Examiner*—Eugene La Roche

[57] ABSTRACT

The invention relates to a programmable timing device of the type which controls a utility unit such as a heating plant on a daily and weekly schedule. The timing device includes clock works and a rotatable unit driven by the clock works. A reflecting disc having a reflecting surface is mounted on the rotatable unit for rotation therewith. A stationary unit holds a light source which directs a light beam towards the reflecting disc. A program disc is mounted on the rotatable unit between the reflecting disc and the stationary unit. The program disc has a predetermined form for masking certain portions of the reflecting surface from the light beam as the rotatable unit rotates relative to the stationary unit. The timing device includes a light sensor for receiving a reflection of the light beam from the reflecting surface. The light sensor is held by the stationary unit in close proximity to the light source.

2 Claims, 6 Drawing Figures

Figure 1:
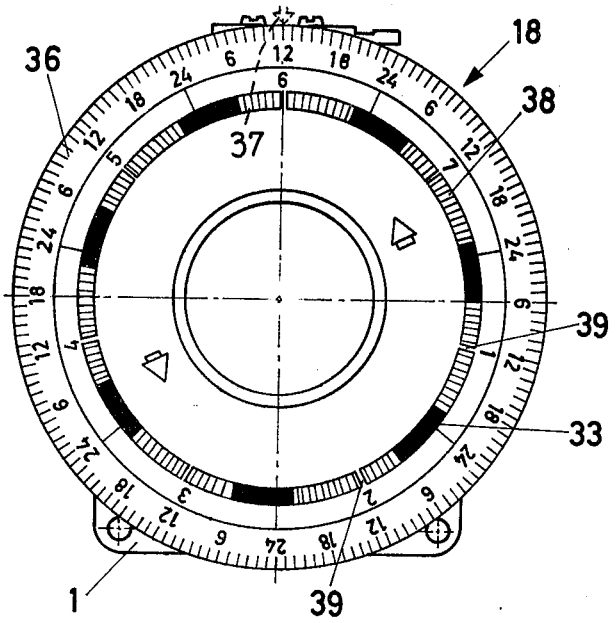

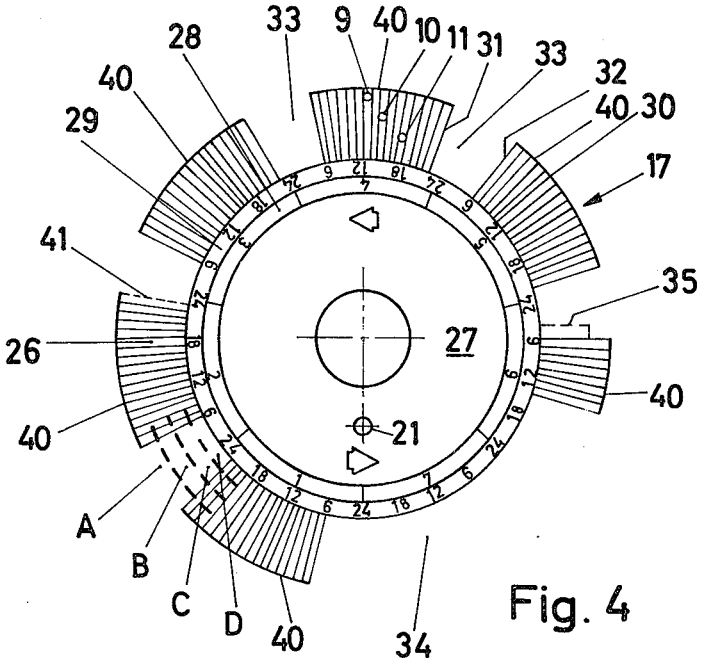
Fig. 4
Fig.5
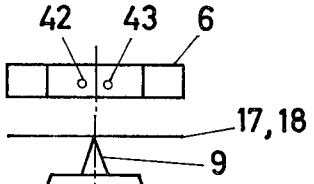
Fig.6
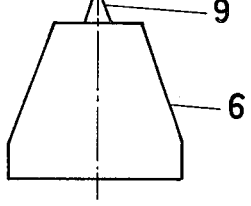

TIME SWITCH WITH ADJUSTABLE PROGRAM

The invention relates to a time switch operated with an adjustable program. The unit includes a rotatable disc operating with a predetermined number of revolutions and a program having, in a circumferential direction, in succession, length-adjustable areas with alternating different characteristics. The time switch further has at least one search means reacting to different characteristicsin delivering a signal corresponding to each characteristic.

The present invention seeks to provide a time switch of the above mentioned sort, which operates without erosion, which is easily adjustable, which shows a higher contact safety, and which does not cause radio interference.

According to the present invention a time switch includes a search means, which is a light-electric means, and the areas of the disc have different optical characteristics.

In this arrangement the search can take place by means of light-beams and thus without erosion. At the same time contact uncertainties, which may arise because of abrasion, are avoided. The light/dark modulation of the light-beams, which takes place during the search, can easily, by means of photoelectric circuits including a photo-cell, a photo-transistor, a photo-thyristor or like components, be transformed into a corresponding electrical signal controlling the current-supply of further electrical circuits, e.g. a relay for setting of the temperature decrease/increase. No radio noise is caused by this transforming. Further the circuits can easily be formed galvanically separated as often required. A special contact-track on the disc supplying the reference potential can be omitted. Instead of this a further contact-circuit may be provided.

While it is possible to chose the light transmission characteristics by variation, whereby on one side of the disc a light-source and on the other side a light-sensor (for instance a photo-cell) were provided, it is preferred that the light-reflection characteristics of the disc-areas vary and that the search means has a light-reflection sensor. In this way one side of the disc is easily accessable for instance for placing of setting means or unimpeded observation of the setting.

Further the sensing range of the light-reflection sensor on the width of the disc-areas measured in the radial direction of the disc may be limited to a fraction of the smallest length of a disc-area. In this way it is possible to prevent the sensor from picking up reflected diffused light from adjoining disc-areas, which would influence the contact safety.

Preferably the distance between the light-reflection sensor and the disc is adjustable. Because of the ultimate angle of sight of the sensor it is possible to adjust the size of the part of the disc-surface, which can be reached by the sensor, i.e. for instance at a correspondingly small angle of sight to limit the area, which can be reached, to a fraction of the adjusted smallest area with the same reflection characteristic. If the sensor is slantly directed on the disc-surface a change in the distance at the same time gives a displacement of the area which can be reached by the sensor on the disc-surface. If several sensors are used the circuit program may be altered in this way.

Further the search means may include a light-source slantly directed to the disc, the distance of which light-source from the disc is adjustable. Thus the area lightened by the light-source may be altered and displaced in relation to the disc, particularly limited to a fraction of the size of a disc-area. At the same time the area searched by the sensor and the lightened area may be brought into coverage. Hereby preferably the light of the light-source should be focused, e.g. converged in one point, so that the lightened area also at a larger distance from the light-source on the disc-surface can be kept small and that correspondingly small circuit-intervals can be adjusted.

Preferably the angle of incidence of the light of the light-source and the angle of reception of the light-reflection sensor are adjustable to equal values relative to a perpendicular to the surface of the disc. This gives a high search-sensitivity and a correspondingly low contact-uncertainty.

The light-reflection sensor and the light-source can form a mechanically firmly assembled unit. Thus it is possible at the same time to adjust the light-source and the light-reflection sensor in relation to the disc without changing their relative position.

A particular advantage accrues if in the beam-path of the search means light-guides are placed, which are lead immediate to the neighbourhood of the disc. These light-guides, for instance glas fibres, make it possible to make a very distinct, practically punctial limitation of the effective lightened and/or searched area and thus to adjust the smallest circuit-interval and control a big number of circuits without enlarging the disc.

Thus the search means may include several light-reflection sensors, each of which is arranged to cooperate with different paths of the disc-areas, and which sensors are displaceable relative to each other within their respective paths. Thus only one light-source is needed for all circuits.

The light-guides associated with the various light-reflection sensors may be displaceable in circumferential and/or in radial directions of the disc. In this case the light-reflection sensors and the light-source may remain in their positions and only the light-guides are displaced in order to change the circuit program.

The disc may have a reflecting base disc and a dull layer covering the reflecting surface with slices corresponding to the required length of the reflecting area. This form of the disc gives an increase in contact-safety in relation to a likewise usable disc, by which the different reflection-characteristics are achieved in that the disc-areas have different light-absorption characteristics or different colors. Further it may in the case of the layer be a question of a program disc, which is separated from the base disc, with slices chosen in accordance with the required circuit programme.

The dull layer may be a black foil, preferably a self-adhesive synthetic, sticked directly to the reflecting surface of the base disc.

It is also possible to create the dull layer of a dye added to the reflecting surface. In case of foil as well as in case of colour it is possible later on to reduce the slices by means of complementary color or foil slices.

On the other hand it is advantageous that the layer, particularly foil or color, can be loosened from the reflecting surface in order to increase the slices later on.

Preferably the dull layer is constituted of at least two program discs turnable relative to each other with slices, which may be brought at least partly into coverage. In this case the length of the slices and the connection pieces between the slices may be altered by means of a simple torsion of the disc relative to each other, without using tools.

Figure 2:
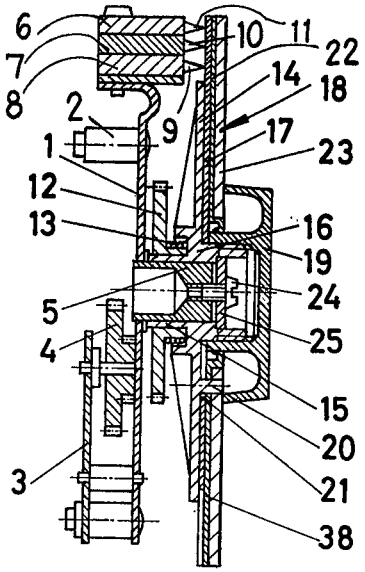
Figure 3:
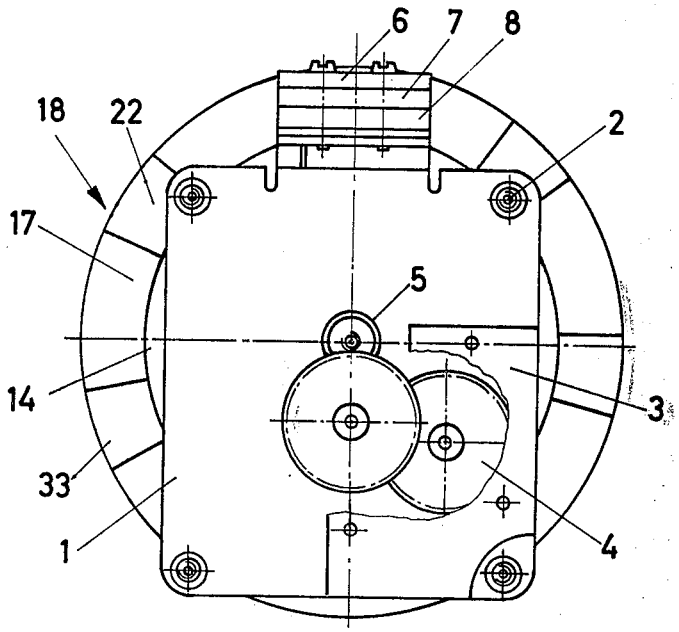

The invention will be described in greater detail by way of example with reference to the drawings, in which FIG. 1 shows a front view of the time switch according to the invention, FIG. 2 shows a vertical cross section through the time switch, FIG. 3 shows a view from the back side of the time switch FIG. 4 shows a program disc with altered program, and

FIG. 5 and

FIG. 6 show a view from below and a side view of an optic-electric search means.

On a supporting frame structure 1, which by means of fastening elements 2 can be placed on the housing of a control unit, a clockwork 3 with an output pinion 4, a bearing pivot 5 and a search means with three radially displaced optic-electric search means 6, 7 and 8 are placed, each of which is containing a light-source and a light-reflection sensor. The light-beams from the search means are marked 9, 10 and 11.

The output pinion 4 operates a toothed wheel 12, which is connected to a contrast disc 14 over a friction clutch 13. The contrast disc has a bearing bush 15, which on one side is carrying the driving toothed wheel 12 and on the inside is resting on the fixed pivot 5. Further the contrast disc shows a centrical pivot 16, on which a program disc 17 and a base disc 18 are fastened by means of a nut 19. Hereby the program disc can be loosely fitted to the base disc. An eccentric pivot 20 grabs through corresponding holes 21 in the program disc 17 and the base disc 18 in order to achieve an exact angular coordination. The base disc consists of a reflecting disc 22, for instance a metal-disc with reflecting surface, which in FIG. 2 lies to the left, and a transparent cover-disc 23. A screw 24 ensures together with a washer 25 the axial position of the contrast disc on the pivot 5. By screwing off the nut 19 the base disc 18 can be taken off and the program disc can be replaced or altered.

FIG. 4 shows a program disc 17 of a black dull self-adhesive synthetic foil with bad reflection-characteristics, consisting of a ring-area 26 with radial lines and a central part 27. Between the ring-area and the central part two concentrical dial rings 28 and 29 are provided, one of which carries day- and the other one hour-indications. Each of the radial lines corresponds to one hour. Along the line 30 the program disc is provided with an absorption line. If the program disc 17 in two radial lines, for instance 31 and 32, is cut by means of scissors, the intermediate part of the ring-area 26 is easily removeable so that a slice 33 occurs. The carving can also take place after the program disc has been sticked to the reflecting area of the base disc 22. Correspondingly the slices may be increased afterwards. It is also possible to reduce them again by sticking corresponding foil-slices on the reflecting area as shown by means of the broken line 41 in FIG. 4. In the program disc according to FIG. 4 five slices 33 are provided, which are reaching from 10 p.m. to 6 a.m. and corresponding to a night-decrease in flow temperature. Only for the weekend a bigger slice 34 is provided, which reaches from Friday at 2 p.m. until Monday at 6 a.m.

Such a program disc is suitable for instance for the steering of the heating in an office building.

The ring-area 26 is divided in four tracks or zones marked A, B, C and D, of which the tracks A-C are searched by one of the search means in order to control the cooperating circuits. For optical reasons the zone D is provided as an enlargement of the ring-area.

In FIG. 4 the light-spots caused by the light-beams 9, 10 and 11 of the search means are shown although they cannot be seen. They are displaced not only in radial direction but also in circumferential direction so that the circuits are actuated after each other. A corresponding displacement of the actuating of the circuit is achieved in that the slices of the various tracks have different circumferential ranges. For instance is in a slice 33 by means of a broken line a boundary line 35 shown, which leaves the slices active in the track A for a longer time than in the tracks B and C.

In the form of construction according to FIGS. 1–3 a program disc 17 is used, which shows equally big slices 33 for all seven days. The transparent cover-disc 23 of the base disc carries on its rear side a double time scale 36, which again is indicating weekdays and hours and is corresponding to the time scale 28, 29 on the program disc. An arrow 37 shown by means of a broken line indicates the time and day when the time switch is installed in a control unit. The reflecting area 22 of the base disc is within the time scale 36 provided with an annular breaking-through 38, and thus only thin connection pieces 39 are connecting the outer ring and the central part of the reflecting disc 22. The breaking-through 38 is in level with the zone D of the program disc 17. In the present example of construction the contrast disc 14 is coloured black on the facade. If now the various discs are built together in the right succession the slices 33 of the program disc are visible through the breaking-through 38.

If the program disc 17 is provided with the required slices and sticked to the reflecting disc 22, the assembling of the discs 14, 17 and 18 when utilizing the friction clutch 13 is turned so much, that the arrow 37 indicates the right day and hour. In the shown position the light-beams 9, 10 and 11 by means of an area 40 of the program disc are held back from the rear-side reflecting area of the reflecting disc and are not reflected. If, on the contrary, the light-beams 9, 10 and 11 get into one of the slices 33, they will meet the reflecting area of the reflecting disc 22. Thus three switches or control circuits can be actuated.

It was already mentioned that the search means may be arranged in such a way that their circuits are actuated temporally after each other. Then all together eight circuit switch function-combinations of the three switch-circuits are available. This gives a great number of control possiblities.

As a rule the program disc is adjusted to the requirements by the installer or the customers. However, this does not exclude that the manufacturer delivers program discs, which are corresponding to the frequently required program flow and which need no or only little adjustment when built in.

It is possible within the frames of the invention to deviate from the shown example of construction. Thus it is possibe to reduce the length of the slices in applying colour to the reflecting area, for instance by means of a felt-pen. Instead of the foil only colour may be applied, for instance by means of a corresponding templet. On the other hand it is possible, according to the application of the circuit, instead of only one program disc to provide two or several firm program discs displaceable relative to each other These may then be displaced in relation to each other in such a way that for instance an area 40 of one program disc overlaps a slice 33 of the other program disc.

The search means 6, 7 and 8 can be displacable in parallel vertically in relation to the disc 17, 18. The light beams 9, 10 and 11 emerging from the search means 6, 7 and 8 can emerge in an angle to the disc 17, 18 and be picked up in an equal angle by the sensor 42 of the search unit, as shown in FIGS. 5 and 6 in the example of the search unit. Hereby the sensor 42 and the light-source 43 may be created separately.

I claim:

1. A timing device comprising clock works and a rotatable unit driven by said clock works, a reflecting disc having a reflecting surface mounted on said unit for rotation therewith, a stationary unit in close proximity to said reflecting disc holding a light source which directs a light beam towards said reflecting disc, a program disc mounted on said rotatable unit between said reflecting disc and said stationary unit, said program disc having a predetermined form for masking certain portions of said reflecting surface from said light beam as said rotatable unit rotates relative to said stationary unit, a light sensor on said stationary unit at a predetermined incidence angle relative to light source and said reflecting disc for sensing reflections of said light beam.

2. A timing device according to claim 1 wherein said light source and said sensor constitute an optical set, and at least one more optical set displaced radially and circumferentially relative to said first mentioned optical set.

* * * * *